US009883291B2

(12) United States Patent
Takahashi et al.

(10) Patent No.: US 9,883,291 B2
(45) Date of Patent: Jan. 30, 2018

(54) PORTABLE TERMINAL

(75) Inventors: Tooru Takahashi, Kyoto (JP); Satoru Iwasaki, Kyoto (JP); Yasuhito Fujii, Kyoto (JP); Harumi Hayashi, Kyoto (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 13/993,209

(22) PCT Filed: Jul. 26, 2012

(86) PCT No.: PCT/JP2012/068967
§ 371 (c)(1),
(2), (4) Date: Jun. 11, 2013

(87) PCT Pub. No.: WO2013/145354
PCT Pub. Date: Oct. 3, 2013

(65) Prior Publication Data

US 2015/0023530 A1 Jan. 22, 2015

(30) Foreign Application Priority Data

Mar. 30, 2012 (JP) ..... 2012-080741

(51) Int. Cl.
*H04R 19/02* (2006.01)
*H04R 17/00* (2006.01)
(Continued)

(52) U.S. Cl.
CPC ..... *H04R 17/00* (2013.01); *B06B 1/0603* (2013.01); *G10K 9/121* (2013.01); *H04R 2499/11* (2013.01)

(58) Field of Classification Search
CPC ..... H04R 17/00; H04R 1/1058
(Continued)

(56) References Cited

U.S. PATENT DOCUMENTS 6,404,085 B2 * 6/2002 Hamaguchi ..... B06B 1/045 310/81
2005/0176459 A1 8/2005 Fukuda
(Continued)

FOREIGN PATENT DOCUMENTS

CN 101133627 A 2/2008
EP 1544720 A1 6/2005
(Continued)

OTHER PUBLICATIONS

Japanese International Search Report, PCT/JP2012-068967, dated Aug. 16, 2012, 2 pp.
(Continued)

*Primary Examiner* — George Monikang
(74) *Attorney, Agent, or Firm* — Volpe and Koenig, P.C.

(57) ABSTRACT

There is provided a portable terminal capable of acquiring sound information successfully simply by being brought near to or into contact with the ear without the necessity of careful handling. The portable terminal includes at least a vibration member having a first surface exposed to an exterior, a vibration element operative to vibrate the vibration member in response to an electric signal corresponding to sound information, and electronic circuitry that outputs the electric signal, a difference in amplitude between individual places within the first surface of the vibration member in a vibrating state being less than or equal to 60 dB in terms of a ratio of maximum value to minimum value of amplitude. A portable terminal can be obtained that is capable of acquiring sound information successfully simply by being brought near to or into contact with the ear without the necessity of careful handling.

8 Claims, 3 Drawing Sheets

(51) Int. Cl.

| | |
|---|---|
| ***G10H 1/043*** | (2006.01) |
| ***B06B 1/06*** | (2006.01) |
| ***G10K 9/12*** | (2006.01) |

(58) Field of Classification Search
USPC ..... 381/190–191, 380, 62
See application file for complete search history.

(56) References Cited

U.S. PATENT DOCUMENTS

| | | | | |
|---|---|---|---|---|
| 2006/0140439 | A1 | 6/2006 | Nakagawa | |
| 2007/0057601 | A1 | 3/2007 | Kawase et al. | |
| 2008/0137883 | A1 | 6/2008 | Araki | |
| 2008/0226109 | A1* | 9/2008 | Yamakata | G10K 13/00 381/339 |
| 2008/0285813 | A1* | 11/2008 | Holm | G06K 9/00013 382/115 |
| 2009/0247236 | A1 | 10/2009 | Kajiwara et al. | |
| 2010/0141408 | A1 | 6/2010 | Doy et al. | |

FOREIGN PATENT DOCUMENTS

| | | | |
|---|---|---|---|
| JP | 2003-102094 | A | 4/2003 |
| JP | 2003348208 | A | 12/2003 |
| JP | 2005-236352 | A | 9/2005 |
| JP | 2005-303938 | A | 10/2005 |
| JP | 2006166029 | A | 6/2006 |
| JP | 2006245799 | A | 9/2006 |
| JP | 2007-074663 | A | 3/2007 |
| JP | 2007082009 | A | 3/2007 |
| JP | 2007-281607 | A | 10/2007 |
| JP | 2007-336418 | A | 12/2007 |
| JP | 2009-246819 | A | 10/2009 |
| WO | WO2012025783 | * | 3/2012 |

OTHER PUBLICATIONS

Japanese Office Action with English concise explanation, Japanese Patent Appln. No. 2013-128700, dated Apr. 1, 2014, 5 pp.
Korean Office Action with English concise explanation, Korean Patent Appln. No. 10-2013-7010777, dated Jun. 27, 2014, 5 pp.
Iwamoto, Naohisa, "KDDI Corporation has manufactured a smart phone equipped with a voice vibration receiver, which is capable of talking on the phone even if earphones or earplugs are worn, by way of trial", WirelessWire News, WirelessWire News editorial department, Sep. 27, 2011, URL, http://wirelesswire.jp/Todays_Next/201109271927.html.
Sonobe, Osamu, "Sound is Directly Transmitted to the Inner Ear: KDDI Corporation and Kyocera Corporation manufactured 'a new auditory smart phone' equippsed with a 'voice vibration element'", ITmedia Mobile, ITmedia Corporation, Sep. 27, 2011, URL, http://www.itmedia.co.jp/mobile/articles/1109/27/news071.html.
Maekawa, Shinko, CEATEC 2011: "Sound is Transmitted by Vibrating the Chassis", KDDI Corporation exhibited a new auditory smart phone, EE times Japan, ITmedia Corporation, Oct. 5, 2011, URL, http://eetimes.jp/ee/articles/1110/05/news025.html.
Japanese Office Action with English concise explanation, Japanese Patent Appln. No. 2013-128700, dated Jul. 15, 2014, 5 pp.
Reconsideration Report with English concise explanation, Japanese Patent Application No. 2013-128700, dated Aug. 18, 2015, 6 pgs.
Chinese Office Action with English concise explanation, Chinese Patent Application No. 201280051404.2, dated Feb. 14, 2016, 6 pgs.
Extended European Search Report, European Patent Application No. 12872673.4, dated Jan. 28, 2016, 8 pgs.

* cited by examiner

PORTABLE TERMINAL

FIELD OF INVENTION

The present invention relates to a portable terminal.

BACKGROUND

For the sake of acquisition of sound information even in a noisy environment, there has hitherto been proposed a portable terminal for effecting transmission of sound information to a human body through insertion of a projection which vibrates in response to sound information, into an external ear canal (refer to Patent Literature 1, for example).

CITATION LIST

Patent Literature

Patent Literature 1: Japanese Unexamined Patent Publication JP-A 2003-348208

SUMMARY

Technical Problem

However, as a problem posed by the above-described conventional portable terminal, the insertion of the projection into the external ear canal entails proper positioning.

The invention has been devised in view of the problem associated with the conventional art as mentioned supra, and accordingly an object of the invention is to provide a portable terminal capable of acquiring sound information successfully simply by being brought near to or into contact with the ear without a necessity of careful handling.

Solution to Problem

A portable terminal according to the invention comprises at least a vibration member having a first surface exposed to an exterior, a vibration element operative to vibrate the vibration member in response to an electric signal corresponding to sound information, and electronic circuitry that outputs the electric signal, a difference in amplitude between individual places within the first surface of the vibration member in a vibrating state being less than or equal to 60 dB in terms of a ratio of maximum value to minimum value of amplitude. A ratio $\gamma$ of an amplitude $\beta$ to an amplitude $\alpha$ is defined by a formula of $\gamma=20 \log 10(\beta/\alpha)$.

Advantageous Effects of Invention

According to the invention, it is possible to obtain a portable terminal capable of acquiring sound information successfully simply by being brought near to or into contact with the ear without a necessity of careful handling.

DETAILED DESCRIPTION OF THE PREFERRED EMBODIMENTS

Figure 1:
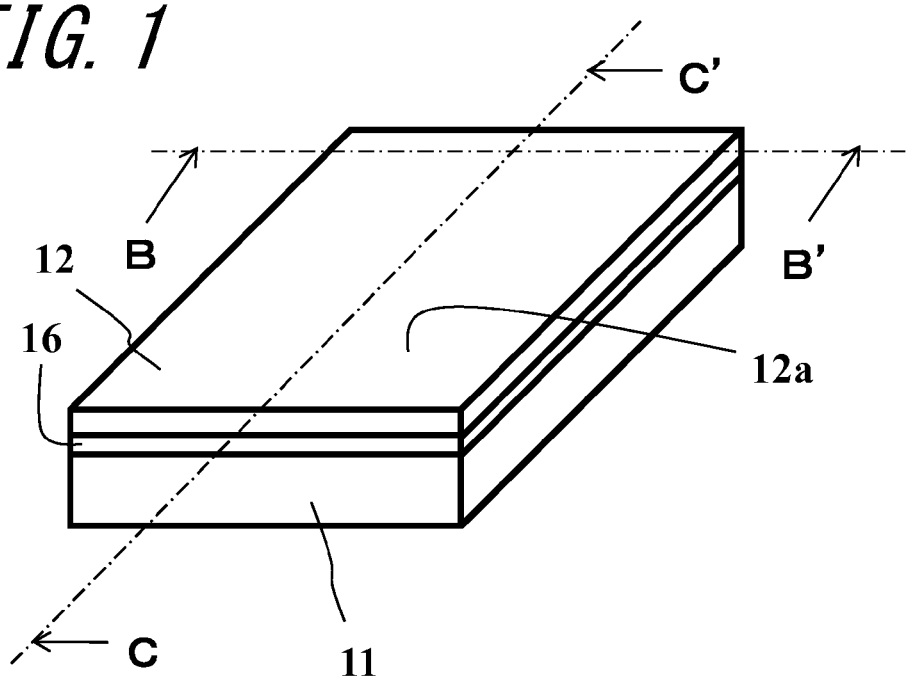
FIG. 1 is a perspective view schematically showing a portable terminal in accordance with an embodiment of the invention.
Figure 2:
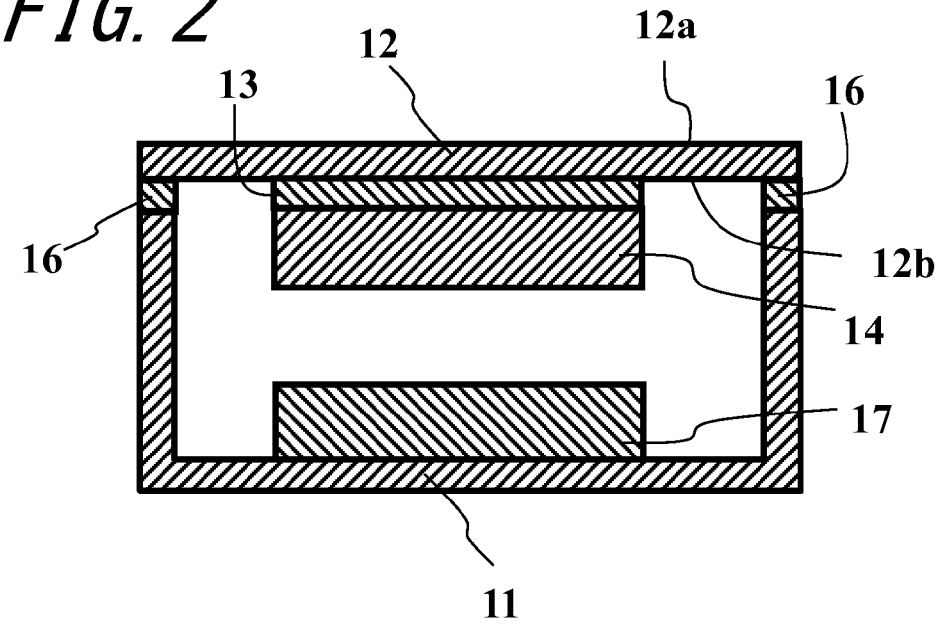
FIG. 2 is a sectional view taken along the line B-B' of FIG. 1.
Figure 3:
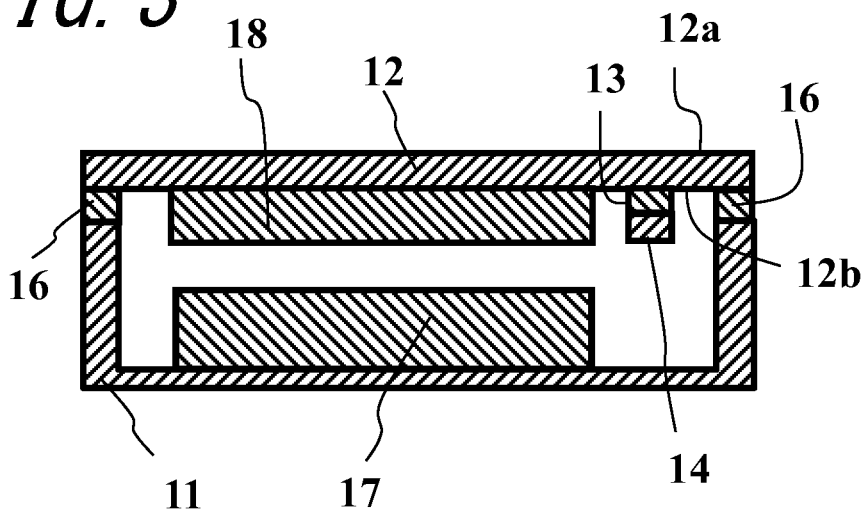
FIG. 3 is a sectional view taken along the line C-C' of FIG. 1.

Hereinafter, a portable terminal pursuant to the invention will be described in detail with reference to the accompanying drawings. FIG. 1 is a perspective view schematically showing a portable terminal in accordance with an embodiment of the invention. FIG. 2 is a sectional view taken along the line B-B' of FIG. 1. FIG. 3 is a sectional view taken along the line C-C' of FIG. 1.

As shown in FIGS. 1 to 3, the portable terminal of this embodiment comprises: a cabinet 11; a vibration plate 12; a first joining member 13; a vibration element 14; a second joining member 16; electronic circuitry 17; and a display 18. The vibration plate 12 serves as a cover for the display 18.

The cabinet 11 is shaped like a box with its one face opened. The cabinet 11 can be made of, as a suitable material, a synthetic resin having great rigidity and elasticity, for example. The cabinet 11 also serves as a support body which supports the vibration plate 12 for vibration.

The display 18 is a display device having the function of displaying image information, and a heretofore known display, such for example as a liquid crystal display, a plasma display, and an organic EL display, is suitable for use as the display 18. Moreover, the display 18 may be configured to include an input device such as a touch panel.

The vibration plate 12 is shaped like a thin plate, and has a first surface 12*a* which is a main surface exposed to an exterior and a second surface 12*b* which is an internal main surface. The vibration plate 12 is configured so that its second surface 12*b* is integrally joined to the display 18, and serves as a cover for the display 18. Note that the cover (the vibration plate 12) of the display is located outward beyond the display 18, and another component may be interposed between the cover and the display 18. The vibration plate 12 can be made of, as a suitable material, an acrylic resin, glass, or the like having great rigidity and elasticity. Moreover, the vibration plate 12 is, only at the periphery of the second surface 12*b*, fixed to the cabinet 11 via the second joining member 16, and thus it is attached to the cabinet 11 for vibration. The thickness of the vibration plate 12 is adjusted to fall in a range from about 0.4 mm to 1.5 mm, for example.

The vibration element 14 is a piezoelectric element made of a plate-like laminated body in which a plurality of polarized piezoelectric layers and a plurality of electrode layers are laminated, and the electrode layers and the piezoelectric layers are alternately arranged. That is, in the vibration element 14, one of the end faces thereof (one main surface) in the direction of arrangement of the plurality of piezoelectric layers is entirely joined to the second surface 12*b* of the vibration plate 12 via the first joining member 13.

Moreover, the vibration element 14 is so designed that one half part and the other half part thereof in the direction of thickness of the vibration element 14 are inversely polarized with respect to the direction of an electric field applied at a certain moment. Accordingly, for example, following the application of an electric signal, when one half part of the vibration element 14 in the thickness-wise direction is caused to stretch in the direction of length of the vibration element 14 at a certain moment, then the other half part of the vibration element 14 in the thickness-wise direction is caused to shrink in the direction of length of the vibration element 14. In this way, the vibration element 14 is able to vibrate in bending mode by itself through the application of an electric signal. Thus, the vibration element 14 is constructed of a piezoelectric body having a bimorph structure (piezoelectric bimorph element).

Upon the input of an electric signal corresponding to sound information, the thusly designed vibration element 14 vibrates in bending mode on the basis of the electric signal. Then, in response to the bending vibration of the vibration element 14, the vibration plate 12 joined via the first joining member 13 to the vibration element 14 vibrates in bending mode. That is, the vibration element 14 causes the vibration plate 12 to vibrate in bending mode on the basis of an electric signal corresponding to sound information.

The vibration element 14 is configured to have a rectangular parallelepiped shape which is, for example, about 15 to 40 mm in length, about 2 to 5 mm in width, and about 0.3 to 1.0 mm in thickness. The piezoelectric layers constituting the vibration element 14 can be made of, as a suitable material, lead zirconate (PZ), lead zirconate titanate (PZT), or a non-lead piezoelectric material such as a Bi-layer compound or a compound with tungsten bronze-type structure, but any other piezoelectric material can also be used. The thickness of a single piezoelectric layer is preferably adjusted to fall in a range from about 0.01 mm to 0.1 mm, for example. Moreover, it is desirable to impart a piezoelectric constant d31 of greater than or equal to 200 pm/V in the interest of acquisition of greater bending vibration. The electrode layers constituting the vibration element 14 can be made of, as a suitable material, for example, a metal component such as silver or a silver-palladium alloy that contains a ceramic component or glass component, but any other heretofore known metal material can also be used.

For example, such a vibration element 14 can be produced by the following method. To begin with, a binder, a dispersant, a plasticizer, and a solvent are admixed in a powdery piezoelectric material and the admixture is stirred to form a slurry, and the resultant slurry is molded into sheet form, thereby forming green sheets. Then, a conductor paste is printed on the green sheet to form an electrode layer pattern, and the green sheets borne on the electrode layer patterns are stacked on top of each other, and the resultant multilayer molded product is subjected to degreasing treatment and firing process, and is then cut into a predetermined dimension, whereupon a multilayer body can be obtained. Next, after the printing of a conductor paste for the formation of a surface electrode with subsequent baking process at a predetermined temperature, a direct-current voltage is applied to the multilayer body through the electrode layers for the polarization of the piezoelectric layers. In this way, the vibration element 14 can be obtained.

It is sufficient that the vibration element 14 be given the function of causing the vibration plate 12 to vibrate in bending mode on the basis of an electric signal. For example, the vibration element 14 may be of a unimorph piezoelectric element. Moreover, the vibration element 14 does not necessarily have to be of a piezoelectric element, but may be of, for example, an electrodynamic vibration element that is well known as a vibration element that vibrates a speaker, an electrostatic vibration element, or an electromagnetic vibration element. The electrodynamic vibration element is of a type which vibrates a coil by passing an electric current through the coil disposed between the magnetic poles of a permanent magnet; the electrostatic vibration element is of a type which vibrates a metal plate by passing a bias and an electric signal through two metal plates opposed to each other; and the electromagnetic vibration element is of a type which vibrates a thin iron plate by passing an electric signal through a coil.

The first joining member 13 has a film-like shape. Moreover, the first joining member 13 is made of a material which is softer and deforms more easily than the vibration plate 12, and is thus smaller than the vibration plate 12 in coefficient of elasticity and rigidity, more specifically Young's modulus, rigidity modulus, volume elasticity modulus, and so forth. That is, the first joining member 13 is deformable, and, when it is subjected to the same force as the vibration plate 12, the first joining member 13 becomes deformed more greatly than does the vibration plate 12. Moreover, the first joining member 13 is configured so that its one main surface is entirely fixed to part of the second surface 12*b* of the vibration plate 12, and its other main surface is entirely fixed to one main surface of the vibration element 14. That is, the vibration plate 12 and the vibration element 14 are joined to each other via the first joining member 13. Note that the first joining member 13 may either be of a one-piece member or be of a composite body formed of several members. As such a first joining member 13, for example, a double-faced tape formed by applying an adhesive to both sides of a base material made of a nonwoven fabric or the like, or a variety of elastic adhesives are suitable for use. The thickness of the first joining member 13 is adjusted to be greater than the amplitude of bending vibration of the vibration element 14, but is regulated to a certain extent to avoid excessive attenuation of vibration ascribable to too large a thickness. For example, the thickness is adjusted to fall in a range from about 0.1 mm to 0.6 mm, for example.

The second joining member 16 has a film-like shape. Moreover, the second joining member 16 is made of a material which is softer and deforms more easily than the vibration plate 12, and is thus smaller than the vibration plate 12 in coefficient of elasticity and rigidity, more specifically Young's modulus, rigidity modulus, volume elasticity modulus, and so forth. That is, the second joining member 16 is deformable, and, when it is subjected to the same force as the vibration plate 12, the second joining member 16 becomes deformed more greatly than does the vibration plate 12. Moreover, the second joining member 16 has its one main surface entirely fixed to the edge of the second surface 12*b* of the vibration plate 12, and has its other main surface entirely fixed to the cabinet 11. That is, the vibration plate 12 and the cabinet 11 are joined to each other via the second joining member 16. Note that the second joining member 16 may either be of a one-piece member or be of a composite body formed of several members. As such a second joining member 16, for example, a double-faced tape formed by applying an adhesive to both sides of a base material made of a nonwoven fabric or the like, or a variety of elastic adhesives are suitable for use. The thickness of the second joining member 16 is regulated so as to avoid excessive attenuation of vibration ascribable to too large a thickness, and is thus adjusted to fall in a range from about 0.1 mm to 0.6 mm, for example. That is, the second joining member 16 is configured for transmission of the vibration of the vibration plate 12 to the cabinet 11.

The electronic circuitry 17 includes a circuit that outputs, to the vibration element 14, an electric signal corresponding to sound information to be transmitted to the human body through the vibration of the vibration plate 12, a circuit for processing image information shown on the display 18, a communication circuit, and so forth. Note that the circuit for processing image information and the communication circuit do not necessarily have to be provided. Moreover, a circuit capable of affording another capability may be provided. Further, a plurality of pieces of electronic circuitry 17 may be provided. Such electronic circuitry 17 is connected to the vibration element 14 and the display 18 as well via non-illustrated wiring.

Figure 4:
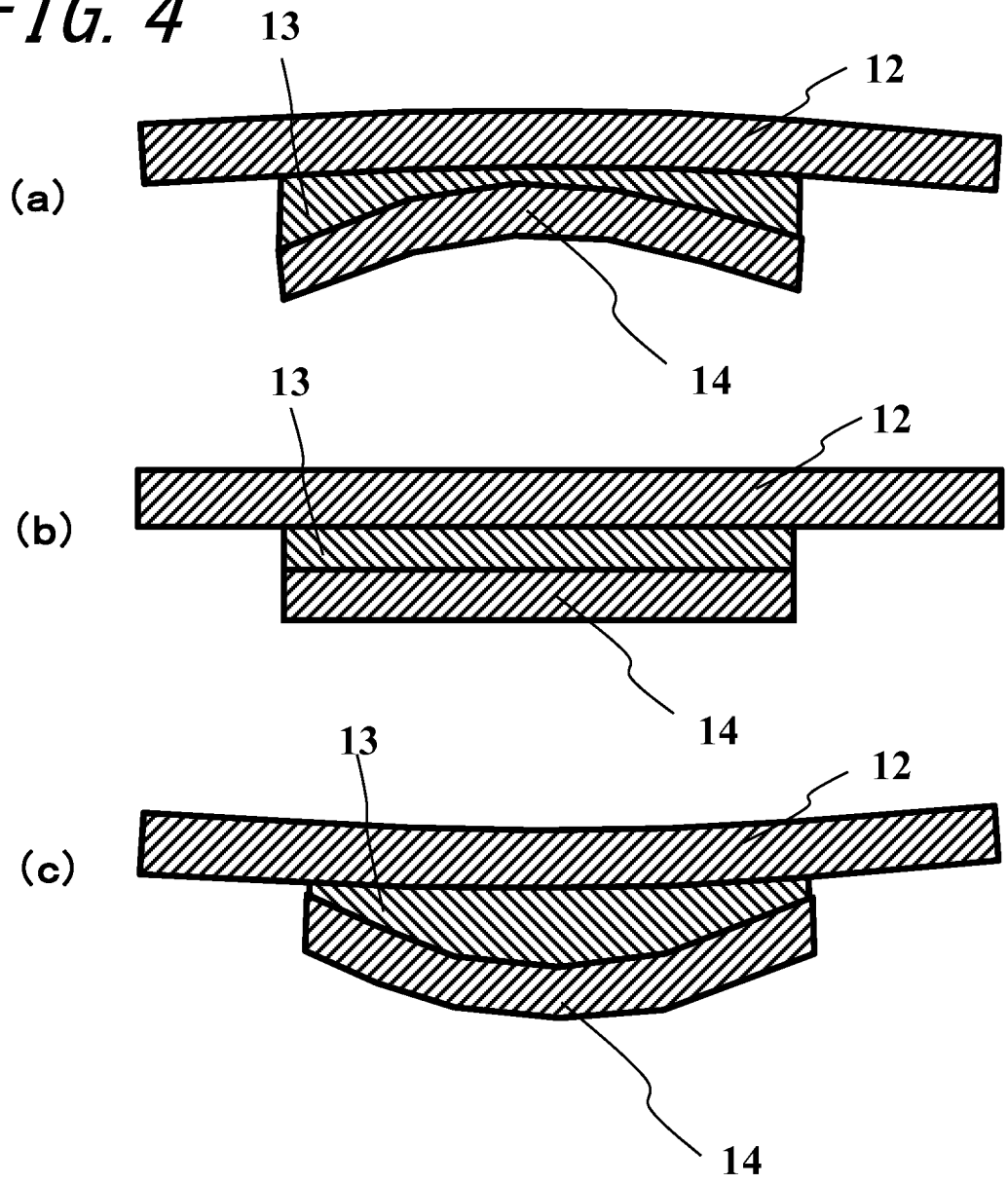
FIGS. 4(*a*) to 4(*c*) are sectional views schematically showing the conditions of vibration of the portable terminal of this embodiment.

FIGS. 4(*a*) to 4(*c*) are sectional views schematically showing the conditions of vibration of the portable terminal of this embodiment. In FIGS. 4(*a*) to 4(*c*), the diagrammatic representation of the cabinet 11, the second joining member 16, the electronic circuitry 17, and the display 18 is omitted.

As has already been described, in the portable terminal of this embodiment, the vibration element 14, which vibrates in bending mode through the application of an electric signal, is joined to the vibration plate 12 via the first joining member 13 which is deformable. Accordingly, upon bending vibration of the vibration element 14 caused by the application of an electric signal, the first joining member 13 permits the vibration of the vibration element 14 with its own deformation, and transmits the vibration of the vibration element 14 to the vibration plate 12.

For example, in the condition as shown in FIG. 4(*a*), the vibration element 14 becomes deformed so as to be convexly curved in an upward direction as viewed in the figure, and the vibration plate 12 is also convexly curved upwardly, but the amount of deformation of the vibration plate 12 is smaller than that of the vibration element 14. On the other hand, in the condition as shown in FIG. 4(*c*), the vibration element 14 becomes deformed so as to be convexly curved in a downward direction as viewed in the figure, and the vibration plate 12 is also convexly curved downwardly, but the amount of deformation of the vibration plate 12 is smaller than that of the vibration element 14. Thus, in the portable terminal of this embodiment, the vibration element 14 vibrates through the application of an electric signal, and, in response to the deformation of the first joining member 13, that part of the vibration plate 12 which is fitted with the vibration element 14 vibrates with an amplitude smaller than the amplitude with which the vibration element 14 vibrates. Accordingly, even when the vibration plate 12 is brought into contact with the human body such as ear, it is possible to suppress hindrance to vibration of the vibration element 14.

Moreover, the thickness of the first joining member 13 is greater than the amplitude of bending vibration of the vibration element 14, and the first joining member 13 is made of a material which is softer and deforms more easily than the vibration plate 12, and is thus smaller than the vibration plate 12 in coefficient of elasticity and rigidity, more specifically Young's modulus, rigidity modulus, volume elasticity modulus, and so forth. That is, the first joining member 13 is deformable, and, when it is subjected to the same force as the vibration plate 12, the first joining member 13 becomes deformed more greatly than does the vibration plate 12.

In a case where the first joining member 13 is hard and is thus not deformed readily, the vibration element 14 and the vibration plate 12 vibrate with substantially the same amplitude. In this case, however, the vibration element 14 is restrained from vibration. For example, in the condition as shown in FIG. 4(*c*), when the vibration element 14 becomes deformed so as to be convexly curved downwardly, one half part thereof on the vibration plate 12 side in the thicknesswise direction is caused to shrink in the direction of length of the vibration element 14. This causes the vibration plate 12 joined to the vibration element 14 to deform so as to be convexly curved upwardly. Consequently, the vibration element 14 and the vibration plate 12 will be curved in opposite directions, which results in a stress that hinders vibration of the vibration element 14.

In the portable terminal of this embodiment, since the first joining member 13 is made of a material which is softer and deforms more easily than the vibration plate 12, it is possible to suppress hindrance to vibration of the vibration element 14 and thereby allow the vibration plate 12 to vibrate greatly, and also, even when the vibration plate 12 is brought into contact with the human body such as ear, hindrance to vibration of the vibration element 14 can be suppressed.

Moreover, in the portable terminal of this embodiment, the vibration plate 12 is secured to the cabinet 11 via the second joining member 16 capable of transmission of vibration, and thus, upon the application of an electric signal, the vibration element 14, the vibration plate 12, and the cabinet 11 vibrate together. Therefore, the amplitude of the vibration plate 12 can be decreased, and also the difference in amplitude between individual places within the first surface 12*a* of the vibration plate 12 can be reduced. Moreover, the mass of the vibration object can be increased, wherefore greater vibration energy can be obtained. This makes it possible to turn down the sound produced from the vibration plate 12, as well as to suppress a decrease in the amplitude of the vibration plate 12 in the case where a load is applied to the vibration plate 12 due to the contact of the vibration plate 12 with the human body such as ear.

The portable terminal of this embodiment is preferably so designed that the difference in amplitude between individual places within the first surface 12*a* of the vibration plate 12 in a vibrating state is less than or equal to 60 dB in terms of a ratio of maximum value to minimum value of amplitude. That is, the vibration plate 12 has been vibrated by the application of an electric signal corresponding to sound information to the vibration element 14 to perform a comparison between the amplitude of the first surface 12*a* of the vibration plate 12 and the audibility obtained when the ear approached the first surface 12*a* of the vibration plate 12, and the result of the comparison showed that the ratio of the amplitude with which the sound is so loud that discomfort may be caused to the minimum amplitude with which the sound information is acquirable (conversation is audible) stood at 60 dB. Note that 60 dB is a value equivalent to the difference between 40 dB which is an audible level where quiet conversation can be heard and 100 dB which is an audible level where a shout in the human ear can be heard. Moreover, there is a proportional relationship between the amplitude of the first surface 12*a* of the vibration plate 12 and a sound pressure in a space close to the first surface 12*a* of the vibration plate 12.

By making adjustment in a manner such that the difference in amplitude between individual places within the first surface 12*a* of the vibration plate 12 in a vibrating state is less than or equal to 60 dB in terms of the ratio of the maximum value to the minimum value of amplitude, it is possible to acquire sound information regardless of which part of the first surface 12*a* of the vibration plate 12 approaches the ear. Hence, according to the portable terminal of this embodiment, it is possible to obtain a portable terminal capable of acquiring sound information successfully simply by being brought near to or into contact with the ear without the necessity of careful handling.

It is more preferable that the difference in amplitude between individual places within the first surface 12*a* of the vibration plate 12 in a vibrating state is less than or equal to 20 dB in terms of the ratio of the maximum value to the minimum value of amplitude. That is, the vibration plate 12 has been vibrated by the application of an electric signal corresponding to sound information to the vibration element 14 to perform a comparison between the amplitude of the first surface 12*a* of the vibration plate 12 and the audibility obtained when the ear approached the first surface 12*a* of the vibration plate 12, and the result of the comparison showed that, by making adjustment in a manner such that the difference in amplitude between individual places within the first surface 12*a* of the vibration plate 12 in a vibrating state is less than or equal to 20 dB in terms of the ratio of the maximum value to the minimum value of amplitude, conversations ranging from a quiet conversation to a loud conversation could be heard regardless of which part of the first surface 12*a* of the vibration plate 12 approached the ear. Note that an audible level where a quiet conversation can be heard stands at 40 dB, whereas an audible level where a loud conversation can be heard stands at 80 dB. That is, there is a level difference of 40 dB between quiet voice and loud voice in conversation. 60 dB, namely the ratio of the amplitude with which the sound is so loud that user discomfort is caused to the minimum amplitude with which sound information is acquirable (conversation is audible) minus 40 dB, namely the level difference between quiet voice and loud voice in conversation, is 20 dB. It will thus be seen that, by making adjustment in a manner such that the difference in amplitude between individual places within the first surface 12*a* of the vibration plate 12 which in a vibrating state is less than or equal to 20 dB in terms of the ratio of the maximum value to the minimum value of amplitude, conversations ranging from a quiet conversation to a loud conversation can be heard successfully regardless of which part of the first surface 12*a* of the vibration plate 12 approaches the ear.

In order to reduce the difference in amplitude between individual places within the first surface 12*a* of the vibration plate 12, it is advisable to bond the periphery of the vibration plate 12 to the cabinet 11 firmly. In so doing, although the amplitude of the vibration plate 12 decreases, the difference in amplitude between individual places within the first surface 12*a* can be reduced. In order to bond the vibration plate 12 to the cabinet 11 firmly, for example, it is advisable to increase the coefficient of elasticity of the second joining member 16, or to increase the area of that region of the vibration plate 12 which is joined to the cabinet 11 via the second joining member 16.

Moreover, the portable terminal of this embodiment is preferably so designed that, in a point A which is a given place within the first surface 12*a* of the vibration plate 12 in a vibrating state, the difference in amplitude between a case where a load of 10 N is applied to the point A and a case where no-load of 10 N is applied to the point A is less than or equal to 60 dB in terms of the ratio of the amplitude corresponding to the no-load case to the amplitude corresponding to the 10 N-loaded case. That is, as the result of measurement of a load applied to the portable terminal when it is brought into contact with the ear for phone conversation, it has been found out that the load was about 10 N in the case of pressing the portable terminal against the ear with some strength. Accordingly, by making adjustment in a manner such that, in the point A which is a given place within the first surface 12*a* of the vibration plate 12 in a vibrating state, the difference in amplitude between the case of applying a load of 10 N to the point A and the case of applying no-load is less than or equal to 60 dB in terms of the ratio of the amplitude corresponding to the no-load case to the amplitude corresponding to the 10 N-loaded case, it is possible to obtain a portable terminal capable of acquiring sound information successfully simply by being brought near to or into contact with the ear without the necessity of careful handling. That is, it is possible to obtain a portable terminal capable of acquiring sound information successfully by any of the following instances: making an approach to the ear; making contact with the ear lightly; and making contact with the ear with some strength.

Moreover, by making adjustment in a manner such that, in the point A which is a given place within the first surface 12*a* of the vibration plate 12 in a vibrating state, the difference in amplitude between the case of applying a load of 10 N to the point A and the case of applying no-load is less than or equal to 20 dB in terms of the ratio of the amplitude corresponding to the no-load case to the amplitude corresponding to the 10 N-loaded case, conversations ranging from a quiet conversation to a loud conversation can be heard successfully simply by bringing the portable terminal near to or into contact with the ear without the necessity of careful handling. That is, conversations ranging from a quiet conversation to a loud conversation can be heard successfully by any of the following instances: making an approach to the ear; making contact with the ear lightly; and making contact with the ear with some strength.

In order to reduce the difference in amplitude between the case where a load is applied to the first surface 12*a* of the vibration plate 12 in a vibrating state and the case where no-load is applied thereto, as has already been described, it is advisable to decrease the coefficient of elasticity of the first joining member 13. Moreover, since firm bonding of the vibration plate 12 to the cabinet 11 is also conducive to the reduction of amplitude difference, it is effective to increase the coefficient of elasticity of the second joining member 16, as well as to increase the area of connection between the vibration plate 12 and the cabinet 11.

Moreover, the portable terminal of this embodiment is preferably so designed that, in a given location within the first surface 12*a* of the vibration plate 12 in a vibrating state, under a condition where the location is subjected to a load of 10 N, the difference in amplitude between individual places within the first surface 12*a* is less than or equal to 60 dB in terms of the ratio of the maximum value to the minimum value of amplitude. That is, it is preferable that, in a given location within the first surface 12*a* of the vibration plate 12 in a vibrating state, when the amplitude of the location in a 10 N-loaded case is measured, then the difference in amplitude between individual places within the first surface 12*a* is less than or equal to 60 dB in terms of the ratio of the maximum value to the minimum value of amplitude. In this case, sound information can be acquired regardless of which part of the first surface 12*a* of the vibration plate 12 is pressed against the ear. Accordingly, it is possible to obtain a portable terminal capable of acquiring sound information successfully simply by being brought into contact with the ear without the necessity of careful handling.

Further, it is more preferable that, in a given location within the first surface 12*a* of the vibration plate 12 in a vibrating state, under a condition where the location is subjected to a load of 10 N, the difference in amplitude between individual places within the first surface 12*a* is less than or equal to 20 dB in terms of the ratio of the maximum value to the minimum value of amplitude. In this case, conversations ranging from a quiet conversation to a loud conversation can be heard successfully regardless of which part of the first surface 12*a* of the vibration plate 12 is pressed against the ear.

In addition, the portable terminal of this embodiment is preferably so designed that the ratio of the amplitude of a place within the first surface 12*a* that exhibits the largest amplitude under a condition where no-load is applied to the vibration plate 12 in a vibrating state to the minimum value in the first surface 12*a* of the amplitude of a given location within the first surface 12*a* of the vibration plate 12 in a vibrating state under a condition where the location is subjected to a load of 10 N is less than or equal to 60 dB. This makes it possible to obtain a portable terminal capable of acquiring sound information successfully simply by being brought near to or into contact with the ear without the necessity of careful handling. That is, it is possible to obtain a portable terminal capable of acquiring sound information successfully by any of the following instances: making an approach to the ear; making contact with the ear lightly; and making contact with the ear with some strength.

It is noted that the invention aims to implement a portable terminal capable of successful acquisition of sound information, and therefore pays no regard for amplitude variation in a micro-level region of the vibration plate 12 that exerts no influence on the acquisition of sound information. What matters in the invention is amplitude variation on a macro level in the first surface 12*a* of the vibration plate 12 that exerts influence on the acquisition of sound information. Accordingly, in amplitude measurement, preferably, an acceleration sensor having a predetermined dimension is stuck to the first surface 12*a* of the vibration plate 12, and amplitude is determined by calculation on the basis of a rate of acceleration detected by the acceleration sensor. Moreover, although it is said that the range of frequency of human conversation is about from 500 Hz to 2 kHz, since the amplitude on a macro level within the first surface 12*a* of the vibration plate 12 varies little with frequency, it is advisable to measure an amplitude obtained when an electric signal of 1 kHz is inputted to the vibration element 14.

Moreover, in the portable terminal of this embodiment, since the first surface 12*a* of the vibration plate 12 is made as a flat face, it is possible to bring an adequately wide area of the first surface 12*a* into contact with the ear successfully simply by bringing the portable terminal into contact with the ear without the necessity of careful handling. Further, the first surface 12*a* has an outer shape larger than that of a rectangle which is 6 cm in length and 3 cm in width. It is said that adult ears average 6 cm in length and 3 cm in width. That is, so long as the first surface 12*a* has an outer shape larger than that of a rectangle which is 6 cm in length and 3 cm in width, the ear can be entirely covered with the vibration plate 12 simply by bringing the portable terminal into contact with the ear without the necessity of careful handling, wherefore the external ear canal can be blocked for suppression of incoming noise. This makes it possible to obtain a portable terminal capable of acquiring sound information successfully simply by being brought into contact with the ear without the necessity of careful handling even in a noisy environment.

Moreover, in the portable terminal of this embodiment, the vibration plate 12 serves as a cover for the display 18. Accordingly, the surface of the portable terminal can be utilized effectively, wherefore it is possible to obtain a compact portable terminal with a large vibration plate 12 capable of acquiring sound information successfully simply by being brought near to or into contact with the ear without the necessity of careful handling.

Although this embodiment has been described with respect to the case where the vibration plate 12 is used also as the cover of the display 18, this does not constitute any limitation. For example, the display 18 as a whole may function as the vibration plate 12, or the display 18 may be so configured that part thereof functions as the vibration plate 12.

EXAMPLES

Next, a concrete example of a portable terminal pursuant to the invention will be described. The portable terminal of the embodiment of the invention as shown in FIGS. 1 to 4 was fabricated for evaluation.

The first step was to produce the portable terminal of the embodiment of the invention as shown in FIGS. 1 to 4. The vibration plate 12 was made of a glass plate which is 95.0 mm in length, 48 mm in width, and 0.7 mm in thickness. The vibration element 14 was given a rectangular parallelepiped shape which is 25.0 mm in length, 4.0 mm in width, and 0.75 mm in thickness. Moreover, the vibration element 14 was constructed by alternately laminating ca. 30 μm-thick piezoelectric layers and electrode layers one after another, and the total number of the piezoelectric layers was 24. The piezoelectric layer was made of lead zirconate titanate (PZT) in which Zr was replaced in part with Sb. As the first joining member 13, a 0.16 mm-thick nonwoven fabric-made base material having an acrylic adhesive coating on both sides was used, and the first joining member 13 was stuck to the entire one main surface of the vibration element 14. As the second joining member 16, a 0.15 mm-thick double-faced tape formed of a nonwoven fabric-made base material having an acrylic adhesive coating on both sides was used. Then, the periphery of the second surface 12*b* of the vibration plate 12 was entirely bonded to the cabinet 11 via the second joining member 16. As the cabinet 11, a synthetic resin-made cabinet was used.

An electric signal was inputted to the vibration element 14 to measure the amplitudes of individual places within the first surface 12*a* of the vibration plate 12. In amplitude measurement, to begin with, an acceleration sensor was set at a measurement point within the first surface 12*a*, and amplitude calculation has been made on the basis of the measured value of the acceleration rate at that point. Subsequently, amplitude measurement has been performed likewise under a condition where the acceleration sensor is pressed from above to apply a load of 10 N. These steps have been performed for each of places within the first surface 12*a* of the vibration plate 12 with varying measurement points.

An electric signal to be inputted to the vibration element 14 has been produced by amplifying, with a power amplifier (POP 120-2.5 manufactured by Matsusada Precision Inc.), a signal generated by a synthesized function generator (FG 110 manufactured by Yokogawa Meters & Instruments Corporation) under a condition of a sine wave of 30 Vpp at 1 kHz.

As the acceleration sensor, SV1109 Series manufactured by NEC Avio Infrared Technologies Co., Ltd. was used, and, the 8 mm-diameter circular surface of the acceleration sensor was stuck to a predetermined position of the vibration plate 12 by an adhesive. A charge signal outputted from the acceleration sensor was converted into a voltage signal by a charge amplifier (AG2101 manufactured by NEC Avio Infrared Technologies Co., Ltd.), and the reading of voltage was effected by a digital oscilloscope (DL1540 manufactured by Yokogawa Electric Corporation) to derive a rate of acceleration by using a formula for conversion between voltage and acceleration included with the charge amplifier. Then, an amplitude β was determined by using a formula expressed as: $\beta=2\alpha/\omega 2$, wherein ω represents angular frequency of the electric signal inputted to the vibration element 14; α represents acceleration rate; and β represents amplitude.

A load cell (C2G1-6K-A manufactured by Minebea Co., Ltd.) was used for measurement of a load applied from above the acceleration sensor, and, the value of a load indicated on Digital Peak Holder (CSD-819C manufactured by Minebea Co., Ltd.) connected to the load cell was read out. The load cell was put under the portable terminal.

That is, on a holder disposed on the load cell was set the portable terminal, with the first surface 12*a* of the vibration plate 12 facing upward, and, the acceleration sensor was stuck to a measurement point on the first surface 12*a* of the vibration plate 12. Subsequently, at first, an electric signal was inputted to the acceleration sensor in this state to measure an amplitude in a no-load case. Next, a load of 10 N was applied from above the acceleration sensor, and an electric signal was inputted to the acceleration sensor in this state to measure an amplitude in a loaded case.

As the result of the measurement, according to a comparison made in the no-load case, in the first surface 12*a*, the amplitude of a smallest-amplitude place was 0.58 μm, and the amplitude of a largest-amplitude place was 2.98 μm. The ratio of the maximum amplitude: 2.98 μm to the minimum amplitude: 0.58 μm was 14.2 dB. Note that the largest-amplitude place corresponds to the location where the vibration element 14 is attached to the back side (the second surface 12*b*), and the smallest-amplitude place corresponds to the end of the side of the vibration plate 12 opposite from the side fitted with the vibration element 14 in the direction of length of the vibration plate 12. Even when changes were made to the frequency of the electric signal inputted to the vibration element 14, the same result was obtained.

Moreover, greatest amplitude variation between the no-load case and the 10 N-loaded case occurred at the location where the vibration element 14 was attached to the back side (the second surface 12*b*), and, the amplitude in the 10 N-loaded case was 0.57 μm. The ratio of the amplitude in the no-load case to the amplitude in the 10 N-loaded case was 14.3 dB.

Further, as to the amplitude of the location subjected to a load of 10 N, the amplitude of a smallest-amplitude place within the first surface 12*a* was 0.15 μm, and the amplitude of a largest-amplitude place within the first surface 12*a* was 0.57 μm. The ratio of the maximum amplitude: 0.57 μm to the minimum amplitude: 0.15 μm was 11.6 dB. Next, with the input of a normal sound signal to the vibration element 14, audibility evaluation has been conducted by bringing the first surface 12*a* of the vibration plate 12 near to or into contact with the ear. The result showed that voices ranging from a quiet voice to a loud voice could be heard successfully simply by bringing the first surface 12*a* near to or into contact with the ear without the necessity of careful handling, with consequent successful acquisition of sound information. Whether the first surface 12*a* is kept out of contact with the ear or it is pressed against the ear, the same effect could be obtained. Moreover, the same effect could be obtained regardless of which part of the first surface 12*a* is pressed against the ear. Further, the contact of the first surface 12*a* with the ear allowed successful acquisition of sound information even in a noisy environment. Thus, the invention has proven itself in respect of its effectiveness.

REFERENCE SIGNS LIST

11: Cabinet
12: Vibration plate
12*a*: First surface
14: Vibration element
17: Electronic circuitry
18: Display

What is claimed is:

1. A portable terminal, comprising:

a piezoelectric vibration element that vibrates in bending mode;

an electronic circuitry;

a casing that forms an outer surface of the portable terminal and accommodates the piezoelectric vibration element and the electronic circuitry, the casing comprising a vibration plate, the casing having a first surface which is exposed to an exterior of the portable terminal and is a main surface of the vibration plate; and a first joining member interposed between the piezoelectric vibration element and the vibration plate, the first joining member being smaller than the vibration plate in coefficient of rigidity and having a thickness greater than an amplitude of bending vibration of the piezoelectric vibration element, the piezoelectric vibration element having a surface which faces the vibration plate and vibrates the vibration plate, the surface of the piezoelectric vibration element being entirely attached to the vibration plate via the first joining member, wherein a difference in amplitude across the first surface of the casing in a vibrating state is less than or equal to 60 dB in terms of a ratio of maximum value to minimum value of amplitude.

2. The portable terminal according to claim 1, wherein, in a point A located at a given place within the first surface of the vibration plate in a vibrating state, a difference in amplitude between a case where a load of 10 N is applied to the point A and a case where no-load is applied to the point A is less than or equal to 60 dB in terms of a ratio of an amplitude corresponding to a no-load case to an amplitude corresponding to a 10 N-loaded case.

3. The portable terminal according to claim 1, wherein, in a given location within the first surface of the vibration plate in a vibrating state, under a condition where the location is subjected to a load of 10 N, a difference in amplitude between individual places within the first surface is less than or equal to 60 dB in terms of a ratio of maximum value to minimum value of amplitude.

4. The portable terminal according to claim 1, wherein the first surface of the vibration plate is made as a flat face.

5. The portable terminal according to claim 1, wherein the first surface has an outer shape larger than that of a rectangle which is 6 cm in length and 3 cm in width.

6. The portable terminal according to claim 1, wherein the vibration plate serves as a display for showing image information, or serves as part of the display, or serves as a cover for the display.

7. The portable terminal according to claim 1, wherein the difference in amplitude is less than or equal to 40 dB.

8. The portable terminal according to claim 1, wherein the difference in amplitude is less than or equal to 20 dB.

* * * * *